United States Patent [19]

Mock

[11] Patent Number: 4,871,177

[45] Date of Patent: Oct. 3, 1989

[54] BOARD GAME

[76] Inventor: Roger C. Mock, 424 Carrier NE., Grand Rapids, Mich. 49505

[21] Appl. No.: 138,593

[22] Filed: Dec. 28, 1987

[51] Int. Cl.[4] ..... A63F 3/00

[52] U.S. Cl. ..... 273/256; 273/278

[58] Field of Search ..... 273/242, 243, 256, 278, 273/279, 257, 275, 284

[56] References Cited

U.S. PATENT DOCUMENTS

| | | | |
|---|---|---|---|
| 3,163,423 | 12/1964 | Jackson | 273/256 |
| 3,756,604 | 9/1973 | Laszlo | 273/256 |
| 4,386,778 | 6/1983 | Hall | 273/256 |
| 4,440,397 | 4/1984 | Butner | 273/256 |
| 4,452,457 | 6/1984 | Atieh et al. | 273/256 |
| 4,535,994 | 8/1985 | Cowan | 273/256 |

*Primary Examiner*—Edward M. Coven
*Assistant Examiner*—William E. Stoll
*Attorney, Agent, or Firm*—Price, Heneveld, Cooper, DeWitt & Litton

[57] ABSTRACT

A business board game in which players attempt to win the game by either purchasing a controlling share of stock of a particular industry or by purchasing a sufficient amount of stock in each industry so as to block any other player from gaining control of an industry; as opposed to merely amassing assets or forcing other players out of the game. The game further includes a variety of cards which effect the profits and losses of the various players owning stocks. Also, the game provides bankruptcy proceedings which enable a player to continue the game and still win.

15 Claims, 3 Drawing Sheets

BOARD GAME

BACKGROUND OF THE INVENTION

The invention pertains to a business board game. Other finance and board games have been developed which attempt to simulate playing the market, buying and running companies, and the like. However, the objectives in these games are to either force the other players out of the game through bankruptcy, to amass more money than anyone else or to amass a certain amount of money first. The games which are based upon the format of driving the other players into bankruptcy to win, is a game of attrition, in which players are forced out of the game before the game is completed. The games which are based upon the formats of amassing the largest amount of money or amassing a certain amount of money first, tend to lack the skill, planning, negotiations, etc. to the extent which may be found in games based upon a different pretext.

SUMMARY OF THE INVENTION

In the present invention, a business board game is designed with the objective of each player attempting to gain control of one or more industries, or alternatively gaining enough control in each industry so that no one else may gain control of an industry.

The game includes a board which has a closed loop path divided into a plurality of spaces, wherein some spaces represent a plurality of different businesses. The businesses, in turn, are grouped into industries. Each business is provided with stock certificates which may be purchased for a predetermined amount. Pursuant to one plan of action, a player may win the game by obtaining a majority of shares in each company in one or more industries. Pursuant to a second course of action, a player may win by controlling a sufficient share in any one company in each industry so that no one else may gain control of any of the industries. Furthermore, a player may remain in the game and still win even after going through a bankruptcy proceeding.

This game creates a new objective in business board games by being based upon the gaining of control of one or more industries, or the blocking of such control. Moreover, everyone may play the entire game since bankruptcy not only does not force anyone from the game, but may be used as a tactical advantage. Further, the interest in the game is enhanced by the provision of a plurality of ways to win. This format reduces the predictability in determining the other players' strategies to win.

FIG. **14*a*** illustrates one side of a strategy/goal card;

FIG. **14*b*** illustrates a second side of a strategy/goal card; and

Figure 15:
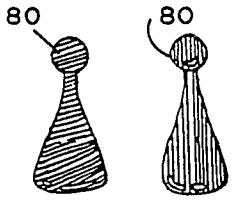

FIG. 15 illustrates tokens which may be provided.

DETAILED DESCRIPTION OF THE PREFERRED EMBODIMENTS

Figure 1:
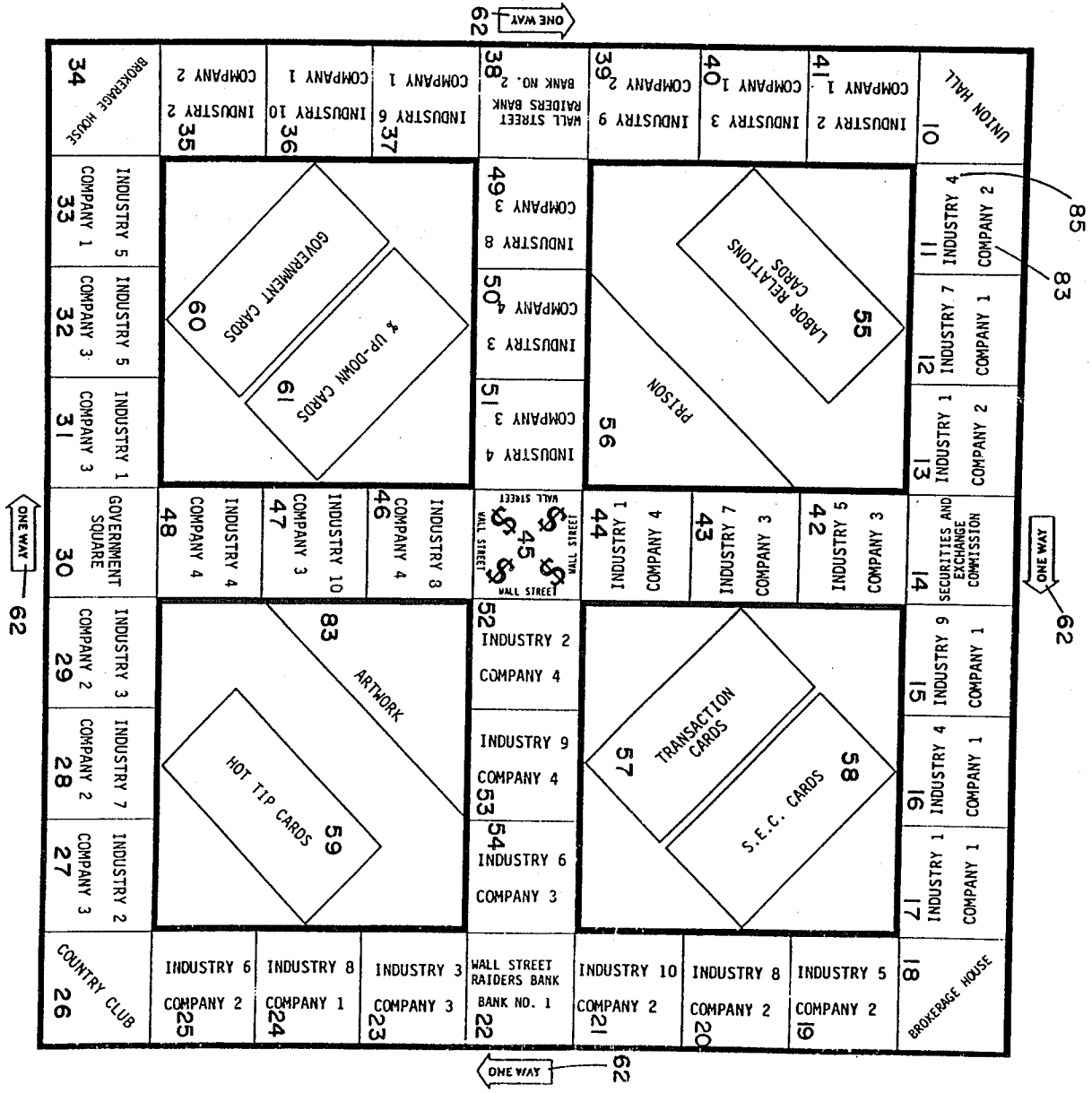
FIG. 1 illustrates a plan view of the board game.
Figure 2:
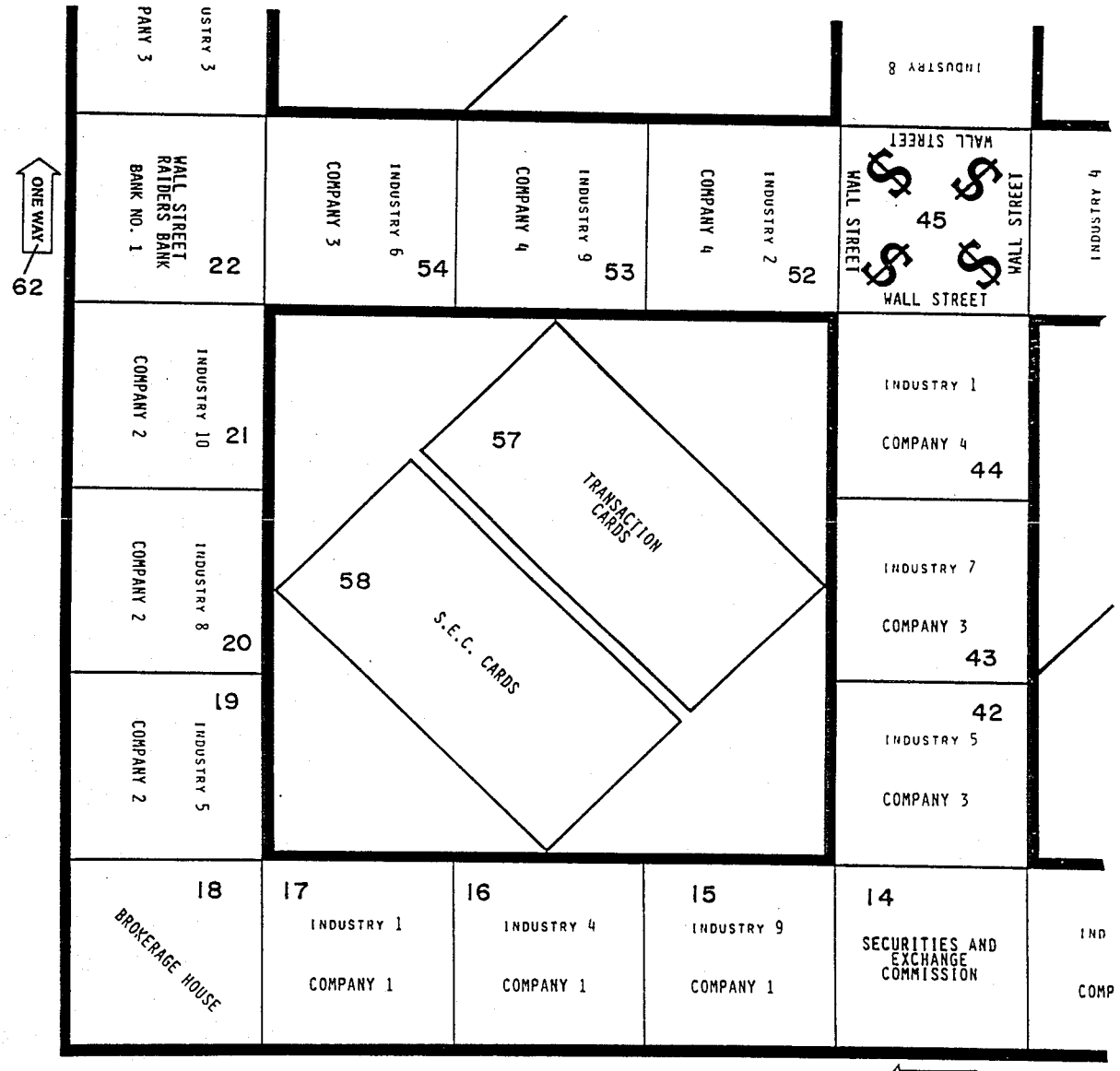
FIG. 2 shows an enlarged corner of FIG. 1.

In FIG. 1 is shown the preferred game board 1 for playing the present business board game. The board is provided with a closed loop path divided into forty-five spaces. Thirty-two spaces form a square around the perimeter of the board. The remaining thirteen spaces form a cross in the interior of the board interconnecting the central spaces of each side. Some of the squares represent different businesses or companies which are grouped, in turn, into different industries. The remaining spaces represent various organizations which effect the marketplace and/or the operation of the businesses provided on the board.

Preferably, ten industries are involved. Each industry is made up of three or four companies which are spaced around in different sections of the board. In the preferred embodiment, industry 1 is represented by four companies on spaces 13, 17, 31 and 44; industry 2 includes four companies which are represented on spaces 27, 35, 41 and 52; industry 3 includes four companies which are represented on spaces 23, 29, 40 and 50; industry 4 includes four companies which are represented oh spaces 11, 16, 48 and 51; industry 5 includes three companies which are represented on spaces 19, 33 and 42; industry 6 includes three companies which are represented on spaces 25, 37 and 54; industry 7 includes three companies represented on spaces 12, 28 and 43; industry 8 includes four companies which are represented on spaces 20, 24, 46 and 49; industry 9 includes four companies which are represented on spaces 15, 32, 39 and 53; and industry 10 includes three companies which are represented on spaces 21, 36 and 47. Hence, four industries include three companies each and six industries include four companies each.

Each space representing a company is provided with an identification of the company name 83, the industry with which it is associated 85, and the par value (purchase price) 87 of each stock certificate 65 for that particular company. Preferably, the spaces for the companies of each industry are color coded for easy identification by the players.

The remaining spaces upon the board include various organizations which effect the marketplace and the operation of the various companies. More specifically, the organizations include: Union Hall represented on space 10; The Securities and Exchange Commission represented on space 14; two Brokerage Firms represented on spaces 18 and 34; two Banks represented on spaces 22 and 38; a Country Club represented on space 26; a Government Square represented on space 30; and Wall Street represented on space 45. Furthermore, a Prison represented on space 56 is also a location upon which a player's token may be placed.

Other marked areas on the board identify locations where activity cards are placed when playing the game. More specifically, these cards include: Labor Relations cards placed on space 55; Transaction cards placed on space 57; S.E.C. cards placed on space 58; Hot-Tip cards placed on space 59; Government cards placed on space 60; and Percentage Up-Down cards placed on space 61.

Further, area 81 is provided as a location upon which a player making an investment in the stock market, or the like, places the money or stocks which he is willing to risk. One way arrows 62 are also provided around the perimeter of the board to indicate the direction a player's token must follow when travelling around the perimeter spaces 10–41.

Figure 4:
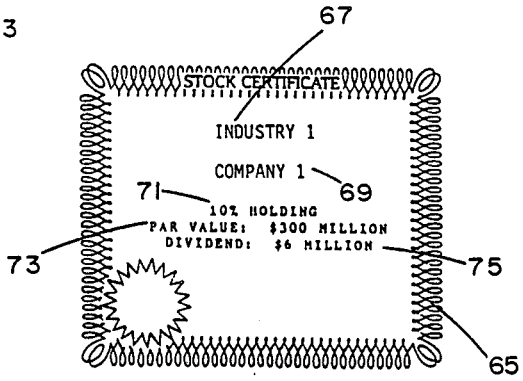
FIG. 4 illustrates a stock certificate.

Each company is provided with ten stock certificates 65 (FIG. 4). Each stock certificate 65 represents a ten percent holding of the particular company. Further, each stock certificate 65 includes: the identification of the particular industry in which the company is included 67, the name of the particular company 69, a notice that each certificate represents a ten percent holding in the company 71, the par value (purchase price) of each stock certificate 73, and the dividend to be paid 75 on each stock certificate 65 when dividends are declared.

The par values (purchase prices) of the stock certificates for the different companies varies across a range of preferably between one hundred million to four hundred and fifty million dollars per stock certificate. Nevertheless, even though the individual companies have differing total assets, each industry has the same amount of total assets. Preferably, the total assets of each industry equals ten billion dollars.

The Basic Game

The number of players is not fixed. Any reasonable number can play, but three to eight players has been found to be most desirable. One of the players is chosen as the banker and is given charge of the money that is not distributed among the players at the start and who also handles on behalf of the bank the loaning of money, the selling of C.D.'s, the selling of stock certificates, the repurchase of stock certificates, etc. Such person may also act as one of the players and for that purpose will be provided with an equal sum of money and in all ways participate in the game with the other players.

One token 80 (FIG. 15) is provided for each player to move along the paths created by the interconnected spaces 10–54. The tokens are typically differentiated with different colors or shapes so that the players may easily identify their own token.

Figure 5:
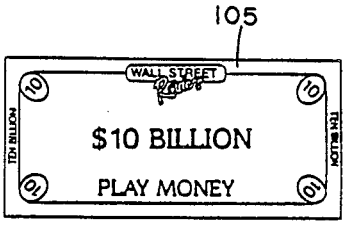
FIG. 5 illustrates an example of the play money which is provided.
Figure 6:
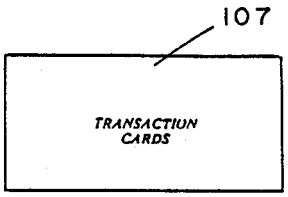
FIG. 6 illustrates one activity card—namely, transaction cards.
Figure 7:
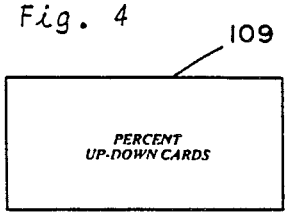
FIG. 7 illustrates a second activity card—namely, percent up-down cards.
Figure 8:
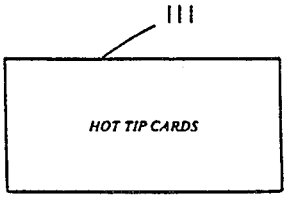
FIG. 8 shows a third activity card—namely, hot-tip cards.
Figure 9:
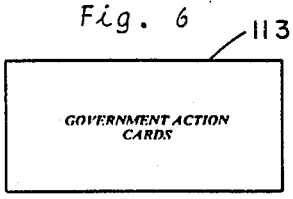
FIG. 9 shows a fourth activity card—namely, government action cards.
Figure 10:
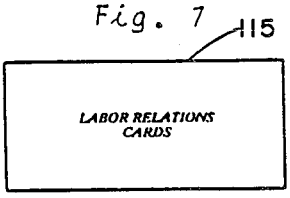
FIG. 10 shows a fifth activity card—namely, labor relations cards.
Figure 11:
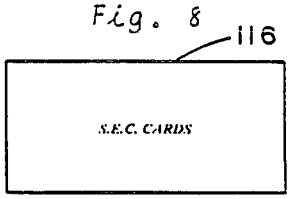
FIG. 11 shows a sixth activity card—namely, S.E.C. cards.
Figure 12:
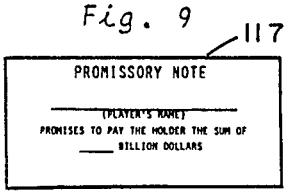
FIG. 12 illustrates promissory notes which are provided.
Figure 13:
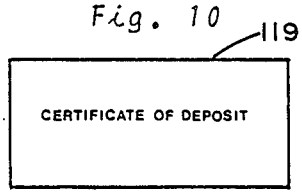
FIG. 13 illustrates certificate of deposits which are provided.

The game also includes a collection of play money in various denominations. FIG. 5 illustrates an example of one particular denomination of ten billion dollars. Preferably, the denominations of money would be provided in increments of one million, five million, ten million, twenty million, fifty million, one hundred million, five hundred million, one billion, five billion and ten billion dollars. Of course, other useful denominations could be used. At the commencement of the game, the banker provides each of the players, including himself if he so participates, with an equal sum of money, for example ten billion dollars in suitable denominations. The banker at the start of the game also holds all the stock certificates for each company.

Figure 14A:
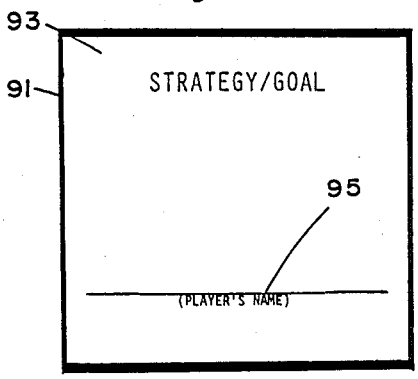
Figure 14B:
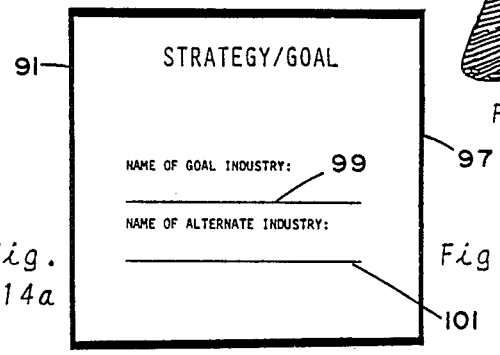

Also at the commencement of the game, each player is given two strategy/goal slips 91 as illustrated in FIGS. **14*a* and 14*b*. On the front side 93 of each strategy/goal slip (FIG. 14*a*) the player writes his name on the line 95 provided. On the back side 97 of slips 91, each player secretly identifies the name of his target or goal industry which he will seek to gain control of during the game on line 99. Each player also secretly identifies the name of an alternate industry which he may attempt to gain control of on line 101. Since these are done in secret, it is possible that more than one player may select the same industry as their target or alternate industry. Each player, upon completion of their strategy/goal slips 91**, folds and gives one copy to the banker to hold until the end of the game, and retains the second copy for his own reference. The banker is not permitted to look at the strategy/goal slips for any player until such player announces that he has won.

The game is provided with four alternative ways in which the game may be won. The first option requires that the player own at least sixty percent of the stock in each company in his target or goal industry, and have net assets which equal at least ten billion dollars. The second option requires that the player obtain at least sixty percent of the stock in each company included in his alternate industry, and have net assets equal to at least ten billion dollars. The third option requires the player to own sixty percent of the stock in each company in any two industries regardless of whether either of the industries were indicated as his target or alternate goal industry, and have net assets equal to at least ten billion dollars. The fourth option requires the player to own at least fifty percent of the stock in at least one company in each of the ten industries on the board. In this particular option, the objective is not to gain a controlling interest in any of the industries, but rather to gain a sufficient interest in each industry so as to block anyone else from gaining control of an industry. Furthermore, in the fourth option, the player is also required to have assets equal to at least fifteen billion dollars. Assets would include the value of any stock held by a player along with any money the player may have on hand including Certificates of Deposit (C.D.'s).

If two players announce at the same time that they have won the game, the above noted options are used to determine the winner, if both players do indeed meet one of the above noted criterias. The priority of the options is in ascending order; that is, option one would be the preferred option, while the fourth option would be the least preferred. For instance, if one of the two players had met the criteria of the third option and the other player had met the criteria of the first option, the player meeting the criteria of the first option would be declared the winner. If both players have met the criteria of the same condition, the player with the highest net assets, then, is declared the winner.

Figure 3:
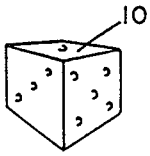
FIG. 3 shows the preferred random generating device, which is typically a dice.

At the start of the game, each player places his token in the center of the board on space 45 which represents Wall Street. From this position, each player on his turn may move in either of the four directions represented by the spaces forming the path. The play is directed by any suitable random number generator such as a dice 103 (FIG. 3). When travelling along the outside perimeter of spaces 10–41, the player must proceed in a clockwise direction as is indicated by arrows 62. However, in the inner cross spaces 42–54 the player is free to choose which direction he may travel, with the sole exception being that he may not reverse his direction of travel during any one turn. When traveling in either the perimeter spaces 10–41 or the inner spaces 42–54, the player may change directions at a junction, so long as he does not reverse his direction in any one turn.

When a player's token lands upon a space representing a company, he is given the option of buying up to twenty percent of the total authorized stock from the bank, so long as the bank is still in possession of stock in that company. There is no requirement to buy any stock, but rather an option to buy one or two certificates in that particular company. The stock is purchased at the par value (purchase price) which is identified not only on the stock certificate, but also on the space on the board which represents that particular company.

If the player already owns stock in the company which is represented by the space upon which he lands, he may declare a dividend before purchasing stock in the company or taking any other action. Each stock certificate 65 is printed with a regular dividend amount which is to be paid out to the holder of such a stock certificate. Note that dividends are paid when declared to any holder of a certificate of that company, regardless of which player actually declared that dividends be paid. The regular dividend rate is two percent of the stock certificate's par value. In those situations when a player already owns all of the stock in a particular company, the dividend paid when declared is double the regular amount listed upon the stock certificate. Hence the dividend rate in this situation would be equal to four percent of the stock certificate's par value.

The remaining spaces 10, 14, 18, 22, 26, 30, 34, 38, 45 on the board which do not represent a company, represent various organizations which effect the marketplace and/or the operations of the various companies. If a player's token lands upon one of these spaces various rules apply, many of which include the drawing of one or more of the various cards which are involved in this game.

All of the cards drawn, except for blue transaction cards, must be complied with at the time they are drawn. Sometimes the cards will require action to be taken and sometimes the cards will merely present an option of an action(s) that may be taken. Furthermore, sometimes the instructions, penalties or benefits printed on the card will effect some or all the players. In fact, sometimes the player drawing the card may not be effected at all, although other players may be. In contrast, blue transaction cards need not be shown to any other player unless exercised in the option authorized by the card. Also, blue transaction cards may be saved for later use or held indefinitely.

Transaction cards 107 include two types, white transaction cards and blue transaction cards. White transaction cards must be shown to all players and acted upon at the time they are drawn. Preferably, white transaction cards will involve: new issues, wherein the bank issues a special offering of all remaining stock in a particular company such that the player is permitted to purchase any or all of the stock held by the bank in that particular company at par value; rumors which give the player the opportunity to risk stock that he owns in a particular company and either gain or lose a particular percentage of the value of the stock; forced buy outs, wherein the player may purchase stock in a particular company owned by the bank at the stock's par value or any other player for one and one half times the stock's par value; or a movement instruction such as "Move to The Securities and Exchange Commission".

Blue transaction cards, in contrast, may be saved for later use or held indefinitely, even if the player does not intend to use the card, to thereby prevent another player from drawing the card at a later time. A blue transaction card does not need to be shown to any other player except when exercising the option authorized by the card. Preferably, blue transaction cards will include defensive options, such as: Green Mail options which may be used by a player owning at least thirty percent (three stock certificates) of the stock in any company against another player who is attempting a forced buy out of the stock in that company—this option gives the holder of this blue transaction card the choice of either selling his stock at one and a half times the par value or purchase from the buyer all of the buyer's stock in the company at one and a half times the par value; Golden Parachute options which may be used by a player owning stock in any company and who is faced with a forced buy out by another player for the stock in that company—the presenting of this card requires the buying player to pay two times the par value for the buy out of all the stock the player owns in that company; or a Poison Pill option which may be used when a player faced with a forced buy out for the stock certificates of a company—this option requires the buyer to pay two times the par value for the forced buy out to all players whose stock he purchases, not just to the player holding the card. Additionally, blue transaction cards may include other items, such as Prison Memoirs which permit you to collect a royalty fee upon leaving prison.

Hot-Tip cards 111 preferably consist of two different types. The first type gives you inside information of something that is going to happen in a particular company or industry and either gives the option of an action(s) or requires certain action which will give you a profit if the information is correct or a loss if the information is incorrect. To determine if you experience a profit or a loss, the player then draws a Percent Up-Down card which will be discussed below. The second type of Hot-Tip cards will include penalties for getting caught using inside information. For instance, the penalties may include losing a turn, going to prison, paying a fine, etc.

The Percent Up-Down cards 109 are used to indicate the amount of loss or gain which a person may experience in different activities. More specifically, the Percent Up-Down cards are utilized in connection with playing the market, taking a risk from a hot tip or other similar activities. These cards merely indicate "up a certain percentage" or "down a certain percentage". Preferably, these range anywhere from a profit of 75 percent, down to a loss of 75 percent.

Government Action cards 113 state activities by the government which effect the operation of various businesses. For example, the cards may include intangible property taxes which must be paid; an audit by the IRS which indicates an underpayment or overpayment of past taxes; a finding of a criminal violation or an investigation thereof which results in a player going to prison, paying a fine, losing a turn, drawing an S.E.C. card as will be discussed later, etc.

The S.E.C. cards 116 are also divided into different types. The first type involves The Securities and Exchange Commission finding or investigating an illegal activity in which one or more players is involved. As with the Government Action cards, this may result in a penalty being levied, such as going to prison, paying a fine, losing a turn, etc. The second type of S.E.C. card gives the player drawing the card the option to make a forced buy out of the stock of a particular company. Preferably, this gives the player the option to buy not only any or all stock in which the bank may hold, but also the stock which may be held by other players as well. The stock which is bought from the bank is purchased at par value. The stock which is purchased from other players is bought at one and a half times the amount of the power value.

Labor Relations cards 115 involve various activities taken on by different unions which effect the operations of various companies included in the game. Preferably, these include the receiving of a profit or the paying out on a loss depending upon whether the news is favorable to your company.

Upon landing on one of the activity spaces, representing one of the organizations, the player is given certain things which he may do at his option and/or things that he must do at that time.

When a player's token lands upon Wall Street, which is represented on space 45, the player is given four things which he may or must do. Firstly, the player is given the option to buy up to twenty percent of the stock in any one company at par value, so long as the bank is still in possession of that amount of stock. In the same way as when a player lands on the space of a particular business, there is no requirement to make any purchase at this time. Secondly, the player must draw a transaction card and follow its instructions. Thirdly, the player is given the option of drawing a Hot-Tip card. Fourthly, the player may play the market, as will be discussed in more detail below.

When a player's token lands upon one of the two Brokerage Houses, which are represented on spaces 18 and 34, he is also given four options that he may or must do, which are very similar to what is involved when landing on Wall Street. Firstly, he may buy up to twenty percent of the stock (two stock certificates) in any company in which he already owns stock at par value, so long as the bank still has stock available in that company. Note that the stock purchased must be in a company in which you already own at least one stock certificate. Secondly, the player must draw a transaction card and follow its instructions. Thirdly, the player is given the option of drawing a Hot-Tip card. Fourthly, the player may play the market, as will be described below.

When a player's token lands upon the Union Hall, which is represented by space 10, he must draw a Labor Relations card and follow the instructions thereon. When a player lands upon the Country Club, represented on space 26, he is given the option of drawing a Hot-Tip card and following the instructions thereon. When a player lands upon the Government square, represented on space 30, he must draw a Government Action card and comply with the instructions thereon. When a player lands on The Securities and Exchange Commission, represented on space 14, he must draw a S.E.C. card and comply with the instructions thereon.

During a player's turn, he may borrow money from the bank, regardless of whether his token has landed upon the bank. However, if the player's token has landed upon one of the two bank spaces, represented on spaces 22 and 38, he may borrow the money at a discounted interest rate. More specifically, if the player borrows money when his token has landed upon one of the Bank spaces, he may borrow the money at a five percent discount; that is, if he borrows one billion dollars, he will receive nine hundred fifty million in cash. If the player borrows money from the bank without landing on one of the Bank spaces, he still may borrow money, but is forced to borrow it at a ten percent discount. For instance, if the player wishes to borrow one billion dollars, he will receive nine hundred million dollars in cash. The maximum amount a player may borrow during any given turn is ten billion dollars. Upon borrowing from the bank, the bank holds a lien against all stocks and other assets that the player owns for all promissory notes payable thereto.

A player may also borrow money from any other player at any time and at whatever interest rates and other terms that are agreed upon by the players. For example, the players may specify the number of turns for repayment of the loan, or may require the posting of certain stocks as security for such loans. Just as with the bank, a promissory note may be used for such private transactions. Also, in a similar vein, a player may at any time offer to buy, sell or trade stock with any player.

If a player indebted to the bank through a previously issued promissory notes lands upon a Bank space, he is required to pay the full amount owed, and may not borrow additional funds from the bank during that turn. However, there are two different banks on the board, and they are considered for this purpose to be separate entities. Therefore, each bank issues its own promissory notes, etc. If a player has borrowed from bank #1 and then later lands on bank #2, he may borrow from bank #2 even though he owes money to bank #1, so long as he is not indebted to bank #2.

Also, during a players turn, he may purchase a certificate of deposit (C.D.) 119 from one of the banks, regardless of whether his token has landed upon one of the Bank spaces represented on spaces 22 and 38. However, as with borrowing money, the player is given an advantage if he purchases the C.D. when his token has landed on one of the Bank spaces. More specifically, if the player's token has landed upon one of the Bank spaces, he may purchase a C.D. for ninety percent of its face value, provided he first pays any obligations owed to that bank and has sufficient cash on hand to purchase the C.D. If the player's token has landed upon any other square, he may purchase a C.D. from the bank for ninety-five percent of the C.D.'s face value. C.D.'s may be purchased in any amount of even multiples of one billion dollars up to a total of ten billion dollars in any given turn. A player may not borrow money from the bank during the same turn in which he purchases a C.D. Further, C.D.'s may be sold to the bank at face value for the purpose of paying any obligation owed to the bank, any government agency, or when purchasing stock from the bank. A player wishing to cash a C.D. for any other purpose must first hold it for at least three turns.

When a player draws a card which requires him to go to prison, he must place his token on the prison triangle. He must stay there for as many turns as his sentence requires. Unless the card specifically authorizes collection of dividends, he may not do so while in prison. However, while in prison, a player may still buy, sell or trade stocks with other players, but he may not participate in any bids or auctions conducted by the bank, which are triggered by the drawing of a card, such as a transaction card. When a player's sentence in prison ends, he moves his token to Wall Street at the beginning of his next turn and rolls the die to determine his movement. The player is not permitted to engage in any activities associated with landing on Wall Street at this time.

When a player has promissory notes, taxes, fines or other obligations which must be paid, either because of landing on the bank while owing the bank money, a note being called, or a player drawing a card which imposes a fine or other obligation, the player must pay the obligation in cash. The player may borrow funds from the bank (unless a promissory note owed to the bank is being called) or from other players. He may sell C.D.'s or stock which he owns. When selling stock to another player, he may sell to the highest bidder. However, when selling stock to the bank, he must sell it at one half of its face value. The bank will pay face value for any C.D.'s which the player possesses.

If a player is unable to sell enough assets to meet his mandatory obligations, and is unable to borrow the funds, he must declare bankruptcy. Additionally, bankruptcy may be declared at any time the player does not have sufficient cash on hand to make a required payment and if the player's total assets are less than his total liabilities when the value of his stock holdings are rated at one half of their par value. Hence, a player may declare bankruptcy even though he may be able to trade or sell stock to other players at a price that would allow him to liquidate his liabilities and still have assets remaining, or borrow the money for such a purpose. When a player declares bankruptcy he must sell all stocks regardless of his goal industries. His target and alternate industries remain the same as originally selected at the beginning of the game. At this time, he may sell stock he owns to the highest bidder, or if he chooses, he may sell all of his stock to the bank at one half of the par value. If the player chooses to sell his stock to the bank during a bankruptcy proceeding, he is required to sell all of his stock to the bank at this price. The only exception to this rule is when the player has borrowed money from another player, and has pledged the stock in a given company as a collateral for the loan. In that instance, the stock in question must be used to pay that specific private obligation, and the stock shall be valued at face value for this purpose. Even though the bank pays only half the par value for the stock, a player may wish to pursue this option rather than sell it to another player, in order to prevent that player from acquiring stock in his target industry. However, a player who sells stock to the highest bidder may end with cash on hand after liquidating all liabilities and selling his assets. Also, if the player is imprisoned at the time of declaring bankruptcy, he must remain in prison for the full term of his original sentence.

If a player declaring bankruptcy liquidates all assets (stocks, C.D.'s, etc.) and still has insufficient funds to pay all creditors, the creditors must absorb the loss and turn over to the player any paid or unpaid promissory notes issued before the bankruptcy proceeding. All obligations owed by the player declaring bankruptcy are to be paid in the following order: (1) notes, fines, taxes and any other obligations owed by the player to the IRS, S.E.C., the courts, or any other mandatory payment owed to any government agency, etc.; (2) notes held by the bank; (3) all promissory notes held by the player forcing the bankruptcy action by demanding payment of one or more notes or through other action; and (4) all other promissory notes and obligations owed to other players.

After the bankruptcy proceeding, the player may then borrow up to five billion dollars from the bank at a ten percent interest cost and continue to play the game. No player is forced out of the game due to bankruptcy. In fact, as mentioned above, bankruptcy may even be used to a tactical advantage in order to prevent other players from gaining specific stocks.

The Advanced Game

The advanced game is primarily played in the same manner as described for the basic game with a couple of exceptions.

While there are still four ways in which a player may win, the four alternatives are different. The first alternative requires a player to own sixty percent of the stock in each company in both his target and alternate industries and have net assets equal to at least ten billion dollars. The second alternative requires a player own one hundred percent of the stock in all the companies in two industries, in which one of those industries is listed on his strategy/goal slip 91 as his goal or alternate industry, and have net assets equal to at least twelve billion dollars. The third alternative requires a player own sixty percent of the stock in each company in three industries, even if none of the three are listed as his goal or alternate industries, and have net assets equal to at least fifteen billion dollars. The fourth alternative requires a player own fifty percent of the stock in at least one company in each industry on the board, and have net assets equal to at least twenty billion dollars. However (except for the banker, which will be discussed below), in order for a player to win under this alternative, he must declare this strategy on his strategy/goal slip 91 by writing "Block" on the slip at the beginning of the game. As discussed in the basic game, this alternative precludes anyone else from being able to meet the criteria of the other alternatives.

Also, as in the basic game, if two players declare themselves winners at the same time, the priority of the options which they have met is in ascending order. For example, if one player has met the criteria of alternative #1 and the other player has met the criteria of alternative #3, the player meeting the criteria of alternative #1 will be declared the winner. If both players have met the criteria of the same alternative, then the player with the largest net assets will be declared the winner.

The banker, in the advanced game, serves in this capacity full time, rather than as a player/banker, because of the increased competitiveness and resulting demands upon the banker's time. Yet, even though the banker does not have a token on the board, he may still play the game and be declared the winner by meeting the criteria of one of the four alternatives. He may therefore establish a private portfolio and draw funds from the bank just as any other player does. The banker meets the criteria in the alternatives by purchasing stock from players, engaging in other transactions, negotiating special loans and managing foreclosures.

The bank's public portfolio of stocks and the banker's private portfolio of stocks are completely separate. The banker may not purchase stock for his private portfolio directly from the bank's public stock portfolio except during a bank auction. Rather, he may only purchase stock from other players. Furthermore, stock held in the banker's private portfolio may not be purchased by a player who lands on a space for any given company, one of the Brokerage Houses, Wall Street, or by drawing a card, unless the banker wishes to sell it.

In many respects, the banker's play is the same as the other players. The banker's private portfolio is permitted to collect dividends when declared and must pay taxes, fines, etc. when any other player holding the same stock would be required to do so. The banker may sell stock from his private portfolio to get the necessary assets to pay promissory notes or to make other purchases of stock. He may loan cash from the private portfolio to other players at whatever interest rate and terms are agreed upon by those involved. Also, he is subject to instructions on cards that are drawn by other players, such as paying of fines, taxes, penalties, margin calls and repayment of loans, collecting tax refunds, extra dividends, etc. The banker may participate in a bank auction. However, this is the only time that the banker may purchase stock directly from the bank for his private portfolio. The banker may also be forced into bankruptcy because of fines or taxes, etc. which he must pay. In such cases, he is subject to the same rules and conditions as any other player declaring bankruptcy.

The banker, in the advanced game, is subject to several advantages and disadvantages in relation to the other players. As advantages, the banker's private portfolio is exempt from forced buy outs and Green Mail, and is not subject to losing a turn or going to prison. Also, because the banker does not have a specific turn, he cannot be required to hold a C.D. for a given length of time, etc. As advantages, the banker may borrow money from the bank by executing a promissory note for the funds at a five percent interest at any time. However, at no time may the banker's private portfolio have outstanding debts (owed to the bank or other players) totalling more than twenty billion dollars, regardless of his net assets. Furthermore, when the banker borrows from the bank's public portfolio, he must roll a die to determine the number of turns (determined by the number of turns taken by the player on his right) before he must repay the specific debt.

The embodiments of the invention in which an exclusive property or privilege is claimed are defined as follows.

1. A business board game for play by two or more players comprising:

a board having a closed loop having four quadrants looped around a centrally located enclosed space constituting the starting point of play;

a plurality of spokes extending outwardly from said centrally located space to said loop path;

said closed loop path and said spokes being divided into a plurality of spaces on which some of the spaces is imprinted a business name and on which others of said spaces is imprinted the name of a bank or one of several other designated organizations; each of said businesses being designated a segment of a designated industry imprinted in the space;

two or more playing pawns employed to designate movement of the player on the closed loop path and spokes;

chance means operated by the players for determining the movement of the pawns from one space to another space on the loop path and/or spokes;

said spaces for businesses of each of said industries being located on different quadrants of said loop path or on different ones of said spokes so that any one industry does not have more than one business in each of said quadrants or in each of said spokes; said spaces for each of said businesses being imprinted thereon a cost for each share so as to designate the purchase price of a share when a player lands on a space for any business thereby permitting the player the opportunity to purchase at least one share thereof;

a plurality of cards for each of said other designated organization spaces, said cards having imprinted thereon instructions which may have a detrimental effect on the progress toward winning the game;

said spaces for each bank and other designated organizations being located between the spaces for businesses of each industry located on said closed loop whereby a pawn moving around said closed loop cannot land on two businesses of the same industry without the risk of landing on one of said spaces for a bank or other organization which might have a detrimental effect on the progress towards winning the game;

a plurality of asset means which are purchased by each player, said asset means including one or a combination of play money and stock certificates;

said stock certificates provided for each of said businesses, and available for purchase with said asset means when a player lands on a space for a business; said purchase of said stock certificates being available until one player obtains a predetermined number of stock certificates in each and every business in any one industry, at which point the player is declared the winner of the game.

2. The business game of claim 1 in which said asset means comprises play money, said bank being authorized to loan money to said players at a predetermined cost and with predetermined terms.

3. The business game of claim 2 in which said bank is further authorized to sell certificate of deposits at a predetermined cost to effect a particular profit margin for a purchasing player.

4. The business game of claim 1 which further comprises play money and a means for facilitating investment in a stock market, and in which at least one of said spaces for other designated organizations is a stock market which is represented on at least one space, wherein a player whose token lands upon said space representing said stock market is given the option of investing assets which include money or stock certificates or both possessed by said player in said market, whereby said means facilitating market investment randomly allocates a percentage of loss or gain of said assets.

5. The business game of claim 4 wherein a player whose token lands upon said space representing said stock market is further given the option to purchase a number of said stock certificates of any of said businesses represented on said board so long as at least one of said stock certificates for said business remains unpurchased.

6. The business game of claim 4 which further includes hot-tip cards which given an inside tip of some pending company action and granting an opportunity to invest assets at the risk of gaining a profit or suffering a loss, wherein a player whose token lands upon said space representing said stock market is further given the option of drawing a hot-tip card and getting the opportunity to make an investment for the risk of some profit or loss.

7. The business game of claim 1 in which at least two of said spaces representing said other organizations are brokerage houses wherein a player whose token lands upon said space representing said brokerage house is given the option of purchasing a number of stock certificates in a business in which he already owns at least one stock certificate, said brokerage house spaces located opposite each other at the juncture of two or said quadrants and said bank spaces being two in number with one located in each of said two quadrants.

8. The business game of claim 1 further comprising labor relations cards which prescribe an activity in which a union effects the operation of at least one business and thereby renders a profit or loss to any one of the players investing in the effected business, and in which at least one of said spaces representing said other organizations is a union hall which is represented by at least one space on said board, wherein a player whose token lands upon said union hall space representing said union must draw a labor relations card and follow the instructions thereon.

9. The business game of claim 1 which further comprises government enforcement cards which relate a government action which effects one or more of said businesses and thereby imposes a gain or penalty upon players investing in said effected business, and in which at least one of said spaces representing said other organizations is a government enforcement unit, wherein a player whose token lands upon said space representing said government enforcement unit must draw a government enforcement card and follow the instructions thereon.

10. A business board game of claim 1 in which:

goal cards are provided to provide a means for each player to choose at the commencement of the game a target industry and an alternate industry; and a plurality of alternate ways by which a player may win, said alternatives including:

(1) the purchase of a majority of the stock certificates in each business included in the player's target industry; and (2) the purchase of a majority of the stock certificates in each business included in the player's alternate industry.

11. The business game of claim 10 in which said plurality of alternate ways to win further includes the purchase of a majority of the stock certificates in each business which is included in any two industries.

12. The business board game of claim 11 in which said plurality of alternative ways to win further includes the purchase of a sufficient number of stock certificates in at least one business from each industry such that no other player may gain a majority of stock in each business in any industry.

13. A business board game of claim 1 in which is provided a bank which retains all of the said play money and stock certificates not possessed by the players, and wherein one player is without a token and acts as the banker but also participates as an individual in the game with his own money, separate from the bank's money, and purchases stock certificates from other players as his own separate from the bank's stock certificates; and movement of said tokens and purchase of said stock continues until one player, regardless of whether the player possesses a token or is the banker, owns a majority of said stock certificates in each business in a particular industry or one player owns a sufficient number of stock certificates in at least one business in each industry so that no other player may gain a majority of stock certificates in each business in any industry whereby at such time said player is declared the winner.

14. The board game of claim 1 in which goal cards are provided for each player to choose his goal of what industry he chooses for obtaining a predetermined number of stock certificates for each business in said industry.

15. The board game of claim 1 in which at least one space for one business of each industry is located in at least one of said spokes.

* * * * *